United States Patent [19]

Skurkiss

[11] 4,082,620

[45] Apr. 4, 1978

[54] PROCESS FOR CHROMATING METALLIC SURFACES

[75] Inventor: Peter Kenny Skurkiss, Short Hills, N.J.

[73] Assignee: Bell Telephone Laboratories, Incorporated, Murray Hill, N.J.

[21] Appl. No.: 792,246

[22] Filed: Apr. 29, 1977

[51] Int. Cl.[2] ..... C25D 5/02; C25D 11/00; C25D 11/38

[52] U.S. Cl. ..... 204/15; 204/56 R

[58] Field of Search ..... 204/15, 18 R, 56 R

[56] References Cited

U.S. PATENT DOCUMENTS

| | | | |
|---|---|---|---|
| 1,750,418 | 3/1930 | McFarland | 204/18 R |
| 1,857,929 | 5/1932 | McFarland | 204/18 R |
| 2,028,013 | 1/1936 | Reilly | 204/18 R |
| 3,475,295 | 10/1969 | Smith et al. | 204/56 R |
| 3,518,169 | 6/1970 | Oyama | 204/56 R |
| 3,523,067 | 8/1970 | Baird-Kerr et al. | 204/15 |
| 3,625,844 | 12/1971 | McKean | 204/140 |
| 3,632,389 | 1/1972 | Vazirani | 204/51 |
| 3,772,165 | 11/1973 | Yamagishi | 204/56 R |

OTHER PUBLICATIONS

Metal Finishing, Sep. 1974, pp. 29–35.

Journal of Electrochemical Society, Jun. 1973, vol. 120, No. 6, pp. 735–738.

Modern Electroplating, 2nd edition, 1963, F. W. Lowenheim, pp. 224–244.

Gold Plating Technology, by Frank Reid et al., 1974, pp. 21–52.

*Primary Examiner*—T. M. Tufariello

*Attorney, Agent, or Firm*—Walter G. Nilsen

[57] ABSTRACT

A process is described for cathodically depositing chromate films on metal surfaces. Metal surfaces of interest are copper, and copper alloy surfaces, nickel, and nickel alloy surfaces, and iron and iron alloy surfaces. Particular electrolytic conditions and solution compositions yield chromate films which are advantageous in many applications including protection of surfaces against corrosion and improved adhesive characteristics of metal surfaces toward various films including organic (paint, etc.) films. In addition, chromate films produced in accordance with the described procedure are advantageous as plating masks for electrolytic deposition of gold.

18 Claims, 4 Drawing Figures

PROCESS FOR CHROMATING METALLIC SURFACES

BACKGROUND OF THE INVENTION

1. Field of the Invention

The invention is a process for electrolytically depositing chromate films on metallic surfaces.

2. Background of the Invention

Chromate films are extensively used in a variety of industrial applications including as corrosion protection and as a film to increase adherence of organic coatings to metallic surfaces. Typical chromating procedures are described in a variety of references including "Chromate Conversion Coatings" by F. W. Eppensteiner and M. R. Jenkins in *Metal Finishing,* September 1975, page 29; "A Study of Surface Chromium on Tinplate" by S. E. Rauch, Jr. and R. N. Steinbicker, in *Journal of Electrochemical Society,* Vol. 120, No. 6, June 1973, Page 735; and, U.S. Pat. No. 3,625,844 issued to Walter A. McKean. Chromating procedures are also described by H. N. Vazirani in U.S. Pat. No. 3,632,389, issued Apr. 3, 1968.

These procedures generally use a 5 percent solution of potassium dichromate or an acidic aqueous solution of chromium trioxide. Although these procedures work well in many applications, it is often desirable to have chromate films which exhibit added corrosion protection greater adhesive qualities or other superior characteristics. For example, chromate films are used as masks for gold electroplating. It is desirable to use more vigorous conditions (higher temperatures, higher current densities, etc.) for gold plating to insure better gold adhesion and more rapid electroplating. With more effective chromate masks, gold electroplating could be carried out under more vigorous conditions without endangering the masking properties of the chromate film toward gold plating.

SUMMARY OF THE INVENTION

The invention is a process for electrolytically depositing chromate films on nickel, copper and iron surfaces in which the chromating solution contains, in addition to a source of chromium for the chromate film, significant amounts of ammonium ion. These surfaces may also contain nickel, copper and/or iron as alloys with each other or other metals, but at least 50 percent by weight of the alloy should be one or more of these metals. Significant effects are obtained particularly in the masking qualities of chromate films for gold plating with concentrations of ammonium ion as low as 0.005 molar. Although significant results might be obtained below this concentration, for many applications particularly commercial applications, the film is not sufficiently improved over conventional procedures. Generally, chromate films are composed of at least 90 percent by weight chromium oxide possibly with the chromium in various oxidation states. The pH of the chromating solution may vary over wide limits consistant with retaining ammonia in the solution, but low pH, generally below 7 is preferred because of thicker, more dense films obtained, greater current density permitted, greater solution stability and retention of ammonia. Higher electrolyte solution temperatures (particularly 50°–90° C) are also preferred since it yields thicker, denser and more effective chromate films. Baking after formation of the chromate film, is often preferred especially where the chromate film is permanent and not to be subsequently removed particularly by etching a baking temperature range between 50° and 200° C generally yields the best results. The chromate film may be patterned (either before or after baking) by various methods including sputtering. Etching may also be used, particularly before baking. With or without patterning, the chromate film may then be used in various applications. The use of chromate films as a mask for gold electroplating is particularly attractive. Chromate films made in accordance with the inventive process yield dense, strong chromate films suitable as a protective layer and as an undercoating adherent film for organic layers. It is also particularly effective as a mask for gold plating.

DETAILED DESCRIPTION

Figure 1:
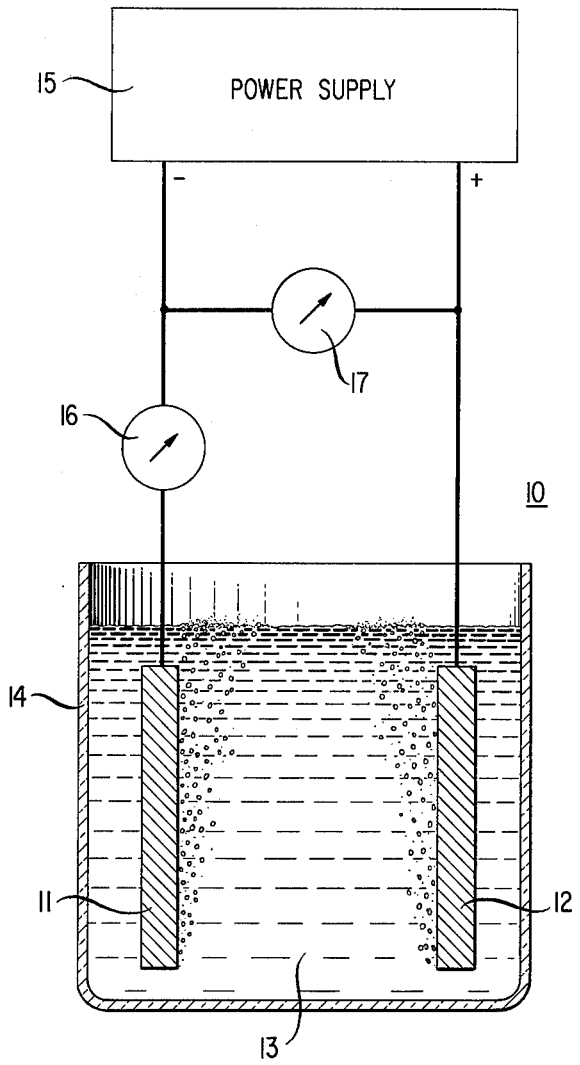
FIG. 1 shows an experimental setup suitable for chromating surfaces in accordance with the invention.

The invention in its simplest form is a procedure for electrolytic depositing chromate films in which the chromate solution contains, in addition to a source of chromium ions, significant amounts of ammonium ions. Even quite small amounts of ammonium ions are effective in the practice of the invention. However, the concentration range between 0.1 molar and saturation is preferred because the greater concentration of ammonium ions leads to denser and more uniform chromate films and allows for greater conductivity of the chromating solution. A concentration range between 2 molar and saturation is preferred especially where high current densities are being used in the electrolytic process.

The ammonium ion may be introduced in a variety of ways including the addition of an ammonium salt such as ammonium chloride and the introduction of gaseous ammonia or ammonia solution. Particularly convenient is the addition of concentrated aqueous ammonia (generally about 15 molar concentration). A concentration range of approximately 10–50 milliliters concentrated aqueous ammonia per 100 milliliters of electrolytic solution yields quite good results. Although pH may be varied over wide limits, generally low pH particularly below pH of 7 is preferred because of higher conductivity of the electrolyte solution and reduced evaporation of ammonia from the solution. The pH may be adjusted in a variety of ways including addition of acid or base etc. Buffering the solution may be advantageous in some cases.

Any source of chromium compatible with the cathodic chromating process may be used. The ion $Cr_2O_7^=$ is used conveniently and may be obtained from a variety of sources including dissolution of $K_2Cr_2O_7$. The concentration of chromium containing ion may vary over wide limits but the range from 0.05 molar to saturation is preferred because it gives reasonable rates of formation for chromate film and the solution can be used for a reasonable time without depletion. A concentration range from 0.5 molar to 2.0 molar is preferred because it gives attractive rates of formation of the chromate film together with reasonable solution life particularly for industrial applications without excessive use of chromate containing substance or adverse affects on the solubility of the ammonium ion.

Various conventional anodes may be used including lead anodes and platinized titanium anodes. Temperature should be between the freezing point of the solution and the boiling point of the solution. However, better films in terms of density and masking qualities are obtained at above room temperature particularly between 50° and 90° C. Current density for the electrolytic process may also vary over wide limits. Choice of current is generally dictated by solution concentration, the conductivity of the chromating solution and time considerations. A range between 50 and 500 amperes per square foot (ASF) is generally quite convenient but current densities outside this range yield perfectly good results and may be convenient under certain circumstances.

Often the chromate films produced in accordance with the invention are used without further processing. In some applications further processing may be carried out, including application of various films to the chromated surface. In particular, organic layers such as paints, photoresists, etc. may be put down on the chromated surface. Also, the film may be patterned for use in various applications. Chromate film patterns may be produced by first fully chromating an entire surface and then removing films from certain designated parts of the surface by abrasion, machining, cutting, etc. Chemical etching is usually done with cone HCl. Patterned chromate films may also be produced by first masking off certain areas with lacquer or photoresist material and then producing the chromate films in accordance with the procedures described above. Rather intricate patterns may be produced by the use of photolithographic procedures well known in the integrated circuit technology using various kinds of photoresist material.

A particularly convenient method of producing patterned chromate films is first to cover a surface with chromate film and then remove film from designated areas using a sputtering technique. Either neutral or charged particles or both are used in the sputtering procedure. This technique is described in detail in a recently filed application designated with Ser. No. 774,482, filed Mar. 4, 1977. The inventors are D. L. Sims, P. K. Skurkiss, and C. W. White.

The sputtering technique is an ideal procedure for evaluating chromate films. This technique also permits monitoring of the removal of chromium ions by observation of the optical radiation given off during sputtering. A particularly convenient apparatus and technique for evaluating chromate films is the so-called SCANIIR surface analysis technique. The word SCANIIR stands for Surface Composition by Analysis of Neutral and Ion Impact Radiation. Measurements of the number of chromium species per unit area are made by monitoring the intensity of optical radiation given off by the sputtered chromium (usually the 4245 angstroms line) as a function of sputtering time. These experiments yield significant differences between chromate films made by conventional means without ammonium ions and those films made in accordance with the invention using ammonium ions. In terms of thickness, assuming constant density of chromium species in the chromate layer, conventionally made layers are approximately 40 angstroms thick whereas chromate layers made in accordance with the invention may have thicknesses of 100 angstroms or more. Indeed, thicknesses of more than 1000 angstroms have been observed and thicknesses over 500 angstroms exhibit good masking and protective properties. Thicknesses over one millimeter are not usually of interest.

Before or after patterning, a baking procedure may be used to improve the properties of the chromate film. Although the baking procedure may be carried out in a variety of atmospheres, generally air yields satisfactory and often best results and is most convenient. Mere drying improves the properties of the chromate film for many applications. Baking at elevated temperatures also is beneficial. Too high a temperature which might compromise the chromate film should be avoided. A temperature range between 50° and 200° C is preferred because it permits rapid baking without danger of compromising the beneficial properties of the chromate film.

Chromate films are particularly useful as masks in a variety of plating applications including gold plating, copper plating, nickel plating and solder plating. The gold plating application is particularly advantageous because of the high cost of gold and its advantageous use in a variety of applications. Chromate films produce in accordance with the above-described procedure with or without patterning are highly advantageous as masks in gold electroplating because more vigorous conditions may be used without compromising the mask qualities of the chromate film. A variety of gold plating procedures may be used. Such gold plating procedures have been described in many references including "Gold Plating Technology" by F. H. Reid and W. Goldie, *Electrochemical Publications Limited,* 1974, and *Modern Electroplating* edited by F. W. Lowenheim, 2nd edition, Wiley, New York, 1963.

Some typical compositions for electroplating solutions are given below. These electroplating procedures may be carried out at various temperatures between the freezing point and boiling point of the solution. Preferred temperatures are given for some examples.

| | | |
|---|---|---|
| 1. | Hard Gold | |
| | Potassium gold cyanide $KAu(CN)_2$ | 12–46 gm/l |
| | Citric acid anhydrous | 80–120 gm/l |
| | KOH | 4–6 gm/l |
| | Cobalt citrate | 100–200 ppm |
| 2. | Hard Gold | |
| | Potassium gold cyanide | 12–46 gm/l |
| | Phosphoric acid to adjust pH to approximately 4.2 | |
| | Cobalt citrate | 100–200 ppm |
| 3. | Soft Gold | |
| | Potassium gold cyanide | 12–46 gm/l |
| | Potassium hydrogen phosphate | 40 gm/l |
| | Potassium dihydrogen phosphate | 10 gm/l |
| | This yields a solution with pH approximately 7.0 and plating should be carried out at a temperature of approximately 65 degrees C. | |
| 4. | Soft Gold | |
| | Potassium gold cyanide | 20 gm/l |
| | $(NH_4)_2 HC_6H_5O_7$ | |
| | pH 5 – 6.5 plating temperature approximately 65 degrees C. | |

A typical apparatus 10 for the practice of the invention is shown in FIG. 1. The surface to be chromated 11 is made the cathode in the electrolytic process. The anode 12 is conveniently made of platinized titanium. Both anode and cathode are immersed in a chromating solution 13 containing, in addition to a source of chromium ions, ammonium ions. A container 14 is used to hold the chromating solution and the anode 12 and cathode 11 are electrically connected to source of electrical energy 15. An ammeter 16 and voltmeter 17 are used to monitor current and voltage. Voltage and current are controlled inside the source of electrical energy 15.

Figure 2:
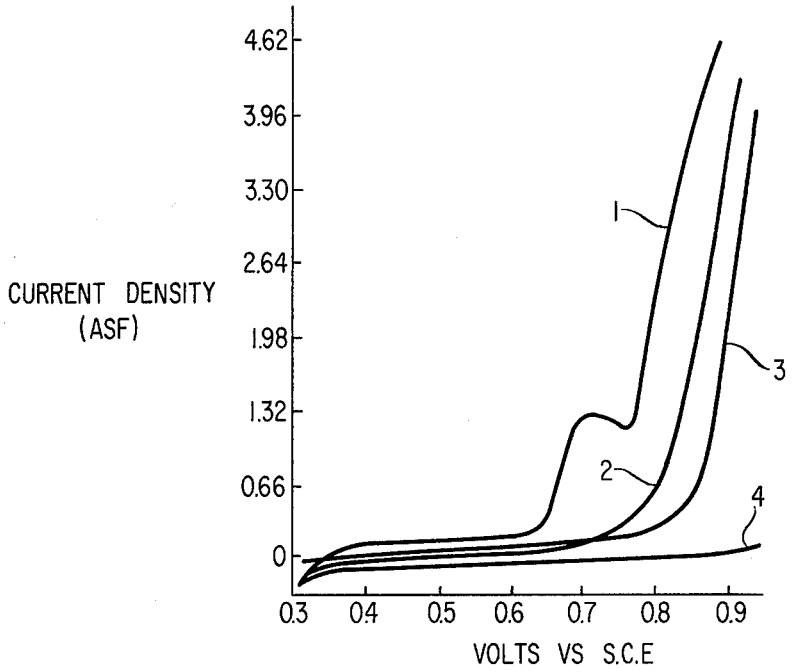
FIG. 2 shows data on ease of gold plating for clean bronze surfaces and surfaces chromated by various processes.

FIG. 2 shows in graphic form some data which demonstrates the masking qualities of chromate films and in particular, the superior masking qualities of chromate films made in accordance with the invention. These graphs show the current-potential relationship for gold electroplating using a citrate gold bath having various surfaces. The current is shown in terms of amperes per square foot (ASF) as the ordinate on the graph. The abscissa of the graph shows the applied voltage as measured against a standard calomel electrode. Curve 1 shows this current potential relation for a phosphor bronze substrate without covering film. The other three curves for phosphor bronze substrates with chromate films applied electrolytically at a current density of approximately 300 ASF. Different chromating solutions were used but in each case, the electrolytic procedure was carried out for approximately 15 minutes using a platinum anode. For curve 2, the cathodic chromating solution contained approximately 5 percent by weight potassium chromate without added ammonium ion. For curve 3, the chromating solution contained in addition to approximately 5 percent by weight potassium chromate, approximately 30 percent by volume of concentrated aqueous ammonia solution. This corresponds to approximately 0.009 molar ammonium ion. Curve 4 resulted from a phosphor bronze surface cathodically chromated with a solution containing approximately 5 percent by weight potassium chromate and approximately 25 percent by weight of ammonium chloride. It should be noted that solutions for curve 3 have an alkaline pH where as the solution for curve 4 is acidic. In FIG. 2, the passage of current at a particular voltage indicates the electroplating of gold on the surface. The superior masking qualities of the chromate films are shown by the successfully higher voltages required for substantial passage of current through the plating solution. Indeed, the superior masking qualities exhibited by the chromate films produced from solutions containing ammonium ion, is quite evident. In the case of the acidic chromating solutions containing ammonium ions (curve 4) substantially no current passes through the surface even at one volt whereas untreated surfaces have large current densities (and therefore substantial gold plating) at this voltage.

More striking results are obtained where the conditions for producing the chromate film are optimized. For example, generally higher temperatures (e.g., 50°–90° C) yield films with superior masking qualities than films produced at room temperature. Although high temperatures above 90° C are advantageous for producing films with good masking qualities, etc., it is sometimes inconvenient because of possible evaporation of ammonia.

This result indicates that at certain voltages, gold will electroplate on unchromated surfaces at substantial rates but not on chromate surfaces. This demonstrates the efficiency of the chromate film prepared in accordance with the invention as a mask for gold plating.

Electrical connectors may also be made in accordance with the inventive procedure. A particular example may be instructive in illustrating the invention. The metallic part of the electrical connector is made from phosphor bronze. This metallic part comes from a long strip of phosphor bronze material which is chromated cathodically prior to being cut into the final connector pieces. After preconditioning and cleaning the surface the chromate film is cathodically deposited using a 5 percent potassium dichromate solution and 25 percent by weight $NH_4Cl$ at room temperature. The phosphor bronze is used as the cathode and a piece of platinum is used as the anode. The distance between the anode and cathode is generally about 1½ inches. Multiple chromating procedures may be used to increase the integrity and thickness of the chromate film and to insure that the entire surface is covered with chromate film. The film may also be dried and baked.

After the phosphor bronze strip is chromated, the metallic connector pieces are punched out in accordance with the well known manufacturing procedures. This leaves part of the surface of the metallic connector piece (the part just cut) free of chromate film. The metalic connector pieces are then gold plated using a conventional hard citrate buffered gold plating bath at 60°–70° C and a current density between 2 to 5 ASF. Only the surfaces exposed by cutting after the chromating procedure obtain a gold plating. The remainder of the surface of the metal connector part is not gold plated because of the effective masking quality of the chromate film.

Figure 3:
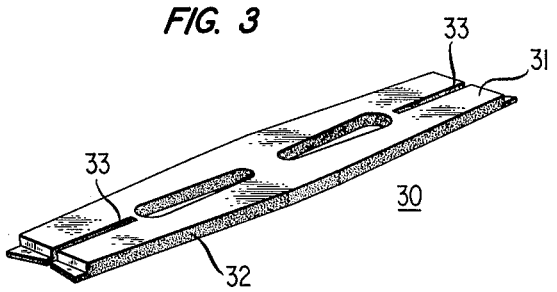
FIG. 3 shows the metallic portion of a multichannel electrical connector including surfaces which are masked by a chromate layer and surfaces which are electroplated with gold.

FIG. 3 shows such a metallic connector part 30 with unplated surface 31 and gold plated surface 32. This procedure drastically reduces the amount of gold used in making such metallic connector parts without affecting device performance since the metal contact occurs on the part of the surface 33 which is gold plated.

Figure 4:
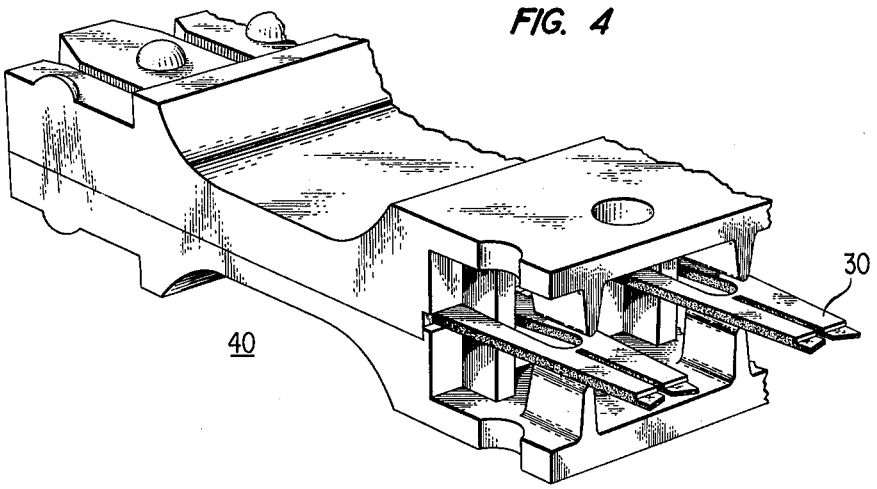
FIG. 4 shows a portion of an electrical connector incorporating the metallic connector with gold plating shown in FIG. 2.

FIG. 4 shows a portion of the assembled electrical connector 40 with metallic connector part 30.

What is claimed is:

1. A process for electrolytically producing a layer on a metallic surface said layer consisting essentially of at least 90 percent chromium and oxygen chemically combined together, including the step of passing electrical current through an anode, aqueous solution and cathode said aqueous solution comprising chromium-containing ions capable of yielding said layer on electrolysis in which the metal surface comprises at least 50 percent by weight of at least one metal selected from the group consisting of copper, nickel, and iron CHARACTERIZED IN THAT the pH of the solution is less than 7 and the solution contains ammonium ions in the concentration range from 0.005 molar to saturation and the layer is used as a mask in an electroplating process involving the plating of a metal selected from the group consisting of gold, copper, nickel and solder.

2. The process of claim 1 in which the concentration of ammonium ion is between 0.1 molar and saturation of the solution.

3. The process of claim 3 in which the concentration of ammonium ion is between 2 molar and saturation.

4. The process of claim 2 in which the ammonium ion is introduced into the solution by the addition of ammonium chloride.

5. The process of claim 2 in which the ammonium ion is introduced into the solution by the addition of aqueous ammonia solution.

6. The process of claim 1 in which the source chromium ion has a concentration range between 0.5 molar and 2.0 molar.

7. The process of claim 1 in which the chromium containing ion is $Cr_2O_7^{=}$.

8. The process of claim 1 in which the chromating solution has a temperature between 50° and 90° C.

9. The process of claim 1 in which the chromate film is patterned after formation of the film.

10. The process of claim 9 in which the patterning is done by chemical etching.

11. The process of claim 9 in which the patterning is done by sputtering.

12. The process of claim 1 in which the layer is baked after formation of the film.

13. The process of claim 12 in which the layer is baked at a temperature between 50° and 200° C.

14. The process of claim 1 in which the metallic surface is a copper alloy.

15. The process of claim 1 in which metallic surface with the layer is punched out so as to expose unlayered metallic surface and the unlayered metallic surface is gold electroplated so as to make an electrical contact of an electrical connector.

16. The process of claim 1 in which the layer, assuming equal density of chromium species with conventional layers, has a thickness of more than 100 angstroms.

17. The process of claim 16 in which the thickness of the layer is greater than 500 angstroms.

18. The process of claim 17 in which the layer thickness is greater than 1000 angstroms.

* * * * *